US005493305A

United States Patent [19]

Wooldridge et al.

[11] Patent Number: 5,493,305

[45] Date of Patent: Feb. 20, 1996

[54] SMALL MANUFACTURABLE ARRAY LATTICE LAYERS

[75] Inventors: John J. Wooldridge, Manhattan Beach; Irwin L. Newberg, Northridge; Joseph P. Smalanskas, Westchester; Ronald I. Wolfson, Los Angeles, all of Calif.

[73] Assignee: Hughes Aircraft Company, Los Angeles, Calif.

[21] Appl. No.: 48,635

[22] Filed: Apr. 15, 1993

[51] Int. Cl.[6] ..... H01Q 3/22

[52] U.S. Cl. ..... 342/368; 342/372; 343/700 MS

[58] Field of Search ..... 342/157, 158, 342/371, 372, 368; 343/700 MS

[56] References Cited

U.S. PATENT DOCUMENTS

| | | | |
|---|---|---|---|
| 4,823,136 | 4/1989 | Nathanson et al. | 342/368 |
| 4,965,605 | 10/1990 | Chang et al. | 343/700 MS |
| 5,023,624 | 6/1991 | Heckaman et al. | 343/860 |
| 5,025,306 | 6/1991 | Johnson et al. | 257/700 |
| 5,115,245 | 5/1992 | Nen et al. | 342/175 |
| 5,142,595 | 8/1992 | Chester | 342/367 |
| 5,198,824 | 3/1993 | Poradish | 343/700 MS |
| 5,218,357 | 6/1993 | Sukamato et al. | 342/351 |
| 5,247,310 | 9/1993 | Waters | 342/368 |

OTHER PUBLICATIONS

McIlvenna, "Monolithic Phased Arrays For EHF Communications Terminals", *Microwave Journal*, Mar. 1988.

Pengelly, "Integrated T/R Modules Employ GaAs ICs" *Microwaves and RF*, Feb. 1985.

*Primary Examiner*—Gregory C. Issing

*Attorney, Agent, or Firm*—Leonard A. Alkov; W. K. Denson-Low

[57] ABSTRACT

An electronic device operating in the microwave frequency range having components disposed in a plurality of planes, wherein the planes are stacked vertically. The electronic device is a T/R module or element forming a part of a subarray used in an active array radar. The T/R module or element comprises a transmit chip, a receive chip, low noise amplifiers, a phase shifter, an attenuator, switches, dc power supply, interconnects that interconnect the foregoing components and logic circuits to control the foregoing components. The components when stacked in a 3-D package are disposed behind a radiator or antenna, which transmits and receives the microwave signals. Behind the T/R module or element is a manifold which provides input and output to and from the T/R module or element. The microwave chips of the T/R module are monolithic microwave integrated circuit chips and control logic, which are disposed in an aluminum nitride substrate and coated with a conformal hermetic coating. The 3-D chip package can optionally include micro channel cooling by adding additional layers. The integrated circuits also employ a flip chip design for mounting to the wafers. Optional photonic interconnects could be used for communication between levels in the 3-D package and can be used between subarrays as a manifold.

17 Claims, 2 Drawing Sheets

SMALL MANUFACTURABLE ARRAY LATTICE LAYERS

BACKGROUND OF THE INVENTION

1. Field of the Invention

The present invention relates to electronics packaging technology. More specifically, the present invention relates to a three-dimensional ("3-D") multi-chip package that operates in the microwave frequency range.

2. Description of the Related Art

One common application for microwave signals was in the field of radar. In earlier radars, the antenna was in the form of a dish, which was mechanically rotated to perform the scanning function. An exciter generated an RF microwave signal which was transmitted through a travelling wave tube, where the RF signal was then amplified to a high level signal and finally radiated out through the mechanical antenna. Rotating the antenna effectively pointed the signal in various directions in the sweeping mode.

The next generation of radars employed phase shifters, no longer relying on the use of a mechanical antenna that needed to be physically rotated in order to sweep an area. In this design, a fixed antenna array was used, and the phase shifter changed the beam direction by shifting the phase of the RF energy. Accordingly, the device electronically steered the beam out of the antenna array.

In the next generation of radar, a concept called an active array transformed the formerly passive fixed antenna into an active radiating mechanism. In such a radar, a plurality of transmit and receive modules ("T/R module or element") sometimes were arranged on a stick or similar configuration. Each T/R module or element was in fact a transmitter and a receiver for the radar all in one. Usually, the T/R module or element included a transmit chip, a receiver chip, a low noise amplifier, a phase shifter, an attenuator, switches, electrical interconnects to connect the components, and logic circuits that controlled the components.

All of the components were disposed on a single substrate in a package which comprised the T/R module or element, which itself was positioned behind a radiator. The radiators and corresponding T/R modules or elements were deployed in a grid. As is known in the art, the microwave signal was emitted and received through the radiators. Behind the T/R modules or elements was a manifold, which provided input and output of the RF signal to and from the T/R modules or elements. Behind the manifold was where the received RF signals were summed, mixed in a receiver, then digitized and supplied to data and signal processors, from which eventually target information was derived.

Using a stick or similar configuration to assemble and package the T/R modules or elements, which comprised an active array, was very expensive. Also, the stick weighed several hundred pounds. Further, the bulk of the active array was often twelve inches or more in depth. Hence, the conventional active array did not have a low profile and accordingly could not be integrated easily into the skin of an aircraft, a missile, or spacecraft, for example, where space limitations are often critical. Even aboard ships, the moment of inertia of a heavy antenna on a tall mast support must be avoided. Consequently, there is presently a need for a more compact subarray that is easily adaptable to cramped environments such as in a missile, tactical aircraft, spacecraft or ground and ship based radar. There is also a need to reduce the cost of manufacturing active arrays.

SUMMARY OF THE INVENTION

Therefore, in view of the foregoing, it is an object of the present invention to provide an active subarray that is highly compact, can be assembled as subarray tiles into a large antenna array and is not bulky. It is another object of the present invention to save space by arranging the electronic (and photonic) components in a 3-D package. Other objects of the present invention include providing a subarray that can be manufactured in a cost effective manner, has high yield during production, is flexible in mounting and assembling into large arrays and exhibits high operating reliability. It is yet another object of the present invention to provide a subarray that can be assembled using automated processes.

To achieve the foregoing objects, the present invention provides one or more T/R modules or elements constructed from electronic components disposed in two or more planes stacked vertically, wherein the T/R module or element operates in the microwave frequency range. Each plane is preferably an aluminum nitride wafer. In a preferred embodiment, the present invention provides a T/R module or element having a transmit chip, a receive chip, a low noise amplifier, a phase shifter, an attenuator, switches, interconnects, and logic circuits. The foregoing electronic components are disposed in a plurality of planes or wafers which are stacked vertically. When stacked as in the present invention, the packaging housing and other related structures are eliminated thereby saving space, weight and costs. By comparison, conventional T/R modules or elements are arranged in a horizontal plane within a module package. Each package includes a housing with associated hardware, which can aggregate when assembled with other T/R modules or elements to result in a very bulky structure.

In the preferred embodiment, the present invention provides that each of the foregoing electronics be embodied in a Microwave Monolithic Integrated Circuit (MMIC) flip chip configuration and also several T/R circuits that form a subarray that consists of one or more T/R circuits and that is made up of the components that were previously assembled into one or more packaged T/R modules or elements. The chips are positioned on a wafer or substrate made from a material such as aluminum nitride. It is preferable to use a flip chip to bring the connections from the substrate to the chip and for better heat transfer from the chip to the heat sinks, located in the substrate, as is known in the art. Furthermore, the MMIC chip, after being located in the substrate wherein a groove is generated to receive the chip, a conformal hermetic coating is disposed over the chip to provide a protective sealant against water or other liquids. In fact, the chip conformal coating replaces the typical T/R module or element metal wall package, thereby reducing the size and weight of the module even further, while retaining hermetic protection.

Furthermore, the preferred embodiment T/R module or element can be cooled by a wafer containing micro channels carrying a liquid coolant. Optionally, either RF or photonic interconnects can be used to interconnect the components between the various planes of the 3-D package and to and from the subarray to the rest of the radar. Thus, the manifold to and from a number of subarray could be either RF, digital, or photonic. As is known in the art, the photonic (optoelectronic or OE) interconnects communicate signals through use of lasers and photodiode detectors that allow transmission of electronic signals through fiber optic cables.

In sum, the present invention 3-D packaging of one or more T/R modules or elements operating in the microwave range yields a compact and lightweight device. The device also has fewer parts, thereby saving manufacturing steps and in turn resulting in lower manufacturing costs. Because disposing the T/R module or element into multiple layers eliminates interconnects and other redundant hardware, the overall weight and the cost of the device are minimized. Quality assurance is also made easier due to fewer parts. For comparison, through applicants' experimental observations, the weight of a 2,000 element array using the present invention technology is estimated to be about 40 pounds. On the other hand, a conventional array using planar T/R modules or elements arranged on sticks having 2,000 channels weighs about several hundred pounds.

DESCRIPTION OF THE INVENTION

In the following description, for purposes of explanation and not limitation, specific numbers, dimensions, materials, etc., are set forth in order to provide a thorough understanding of the present invention. It is apparent to one skilled in the art, however, that the present invention may be practiced in other embodiments that depart from the specific embodiments detailed below.

Figure 1:
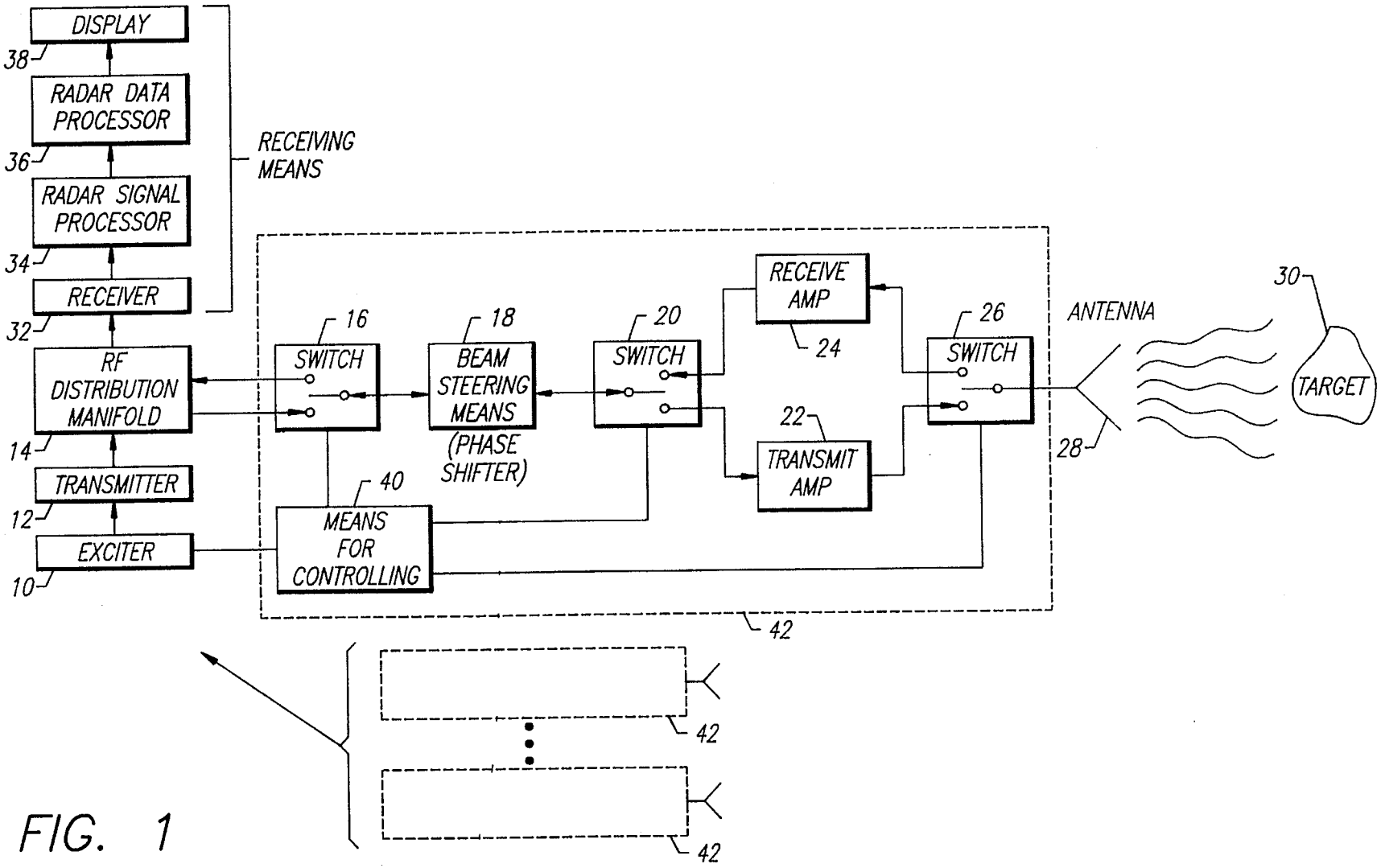
FIG. 1 is a block diagram showing the electronic components of the present invention stacked subarray.

FIG. 1 provides a block diagram of a radar system incorporating a T/R circuit or a subarray element 42 in accordance with a preferred embodiment of the present invention. The radar system of FIG. 1 includes the array units consisting of an exciter 10 to generate a microwave carrier frequency for a transmitter 12. The transmitter 12 modulates the carrier signal with intelligence and feeds the modulated carrier to an RF distribution manifold 14, which directs the microwave energy into the subarray element 42. Specifically, the microwave signal is conveyed to a beam steering means 18. The beam steering means 18 is embodied in a phase shifter which, as is known in the art, changes the relative phases of the microwave signal respectively radiated or received by the antenna elements, which accordingly controls the direction of the antenna beam direction. The phase shifted microwave signal is then directed to a transmit amplifier 22, which comprises a high power transmit FET amplifier. Once the microwave signal is amplified, it is radiated through a mechanically fixed radiator or antenna 28, and propagated toward the target 30.

Thereafter, the beamed energy is reflected from the target 30 and is detected by the antenna 28. The relatively weak energy received by the antenna 28 is amplified by a low noise FET amplifier 24. To use the same antenna 28 for both transmission and reception, a switch 26 is provided to toggle the circuit between transmission and reception. After the reflected microwave signal is amplified, it is directed to the beamed steering means 18. Again, another switch 20 selectively actuates the transmit amp 22 or the received amp 24 depending upon transmission or reception of the beamed signal. In the beamed steering means 18, the relative phases of the energy received from the antenna 28 is controlled to define the received beam direction of the antenna. The signal is then passed to the RF distribution manifold again, which directs the signal to a receiver 32. Next, the signal is passed to a radar signal processor 34 and a radar data processor 36 before being displayed on a monitor 38.

A switch 16 selectively chooses between the transmit circuit and the receive circuit. This switch 16 is controlled and coordinated, as are switches 20 and 26, by a means for controlling 40, which in a preferred embodiment could be logic circuits, a microprocessor or similar device known in the art. In fact, control of the transmitter, receivers, amplifiers, true time delay phase shifters, attenuators, and like RF components are performed by conventional microprocessors. Their construction and theory of operation are known to those skilled in the radar art.

The subarray element 42 of FIG. 1 is preferably connected with other subarray elements 42, shown by the phantom line boxes. The subarray elements 42 thus operate collectively as a unitary radar device.

Unique to the present invention is that the subarray element 42 shown in FIG. 1 is arranged such that its electronic components are disposed among a plurality of planes that are stacked in a single column. The entire stacked chip package operates in the microwave frequency spectrum, except for the digital control circuits. By virtue of the vertically stacked planes, the signals among the electrical devices are passed vertically through the planes.

Figure 2:
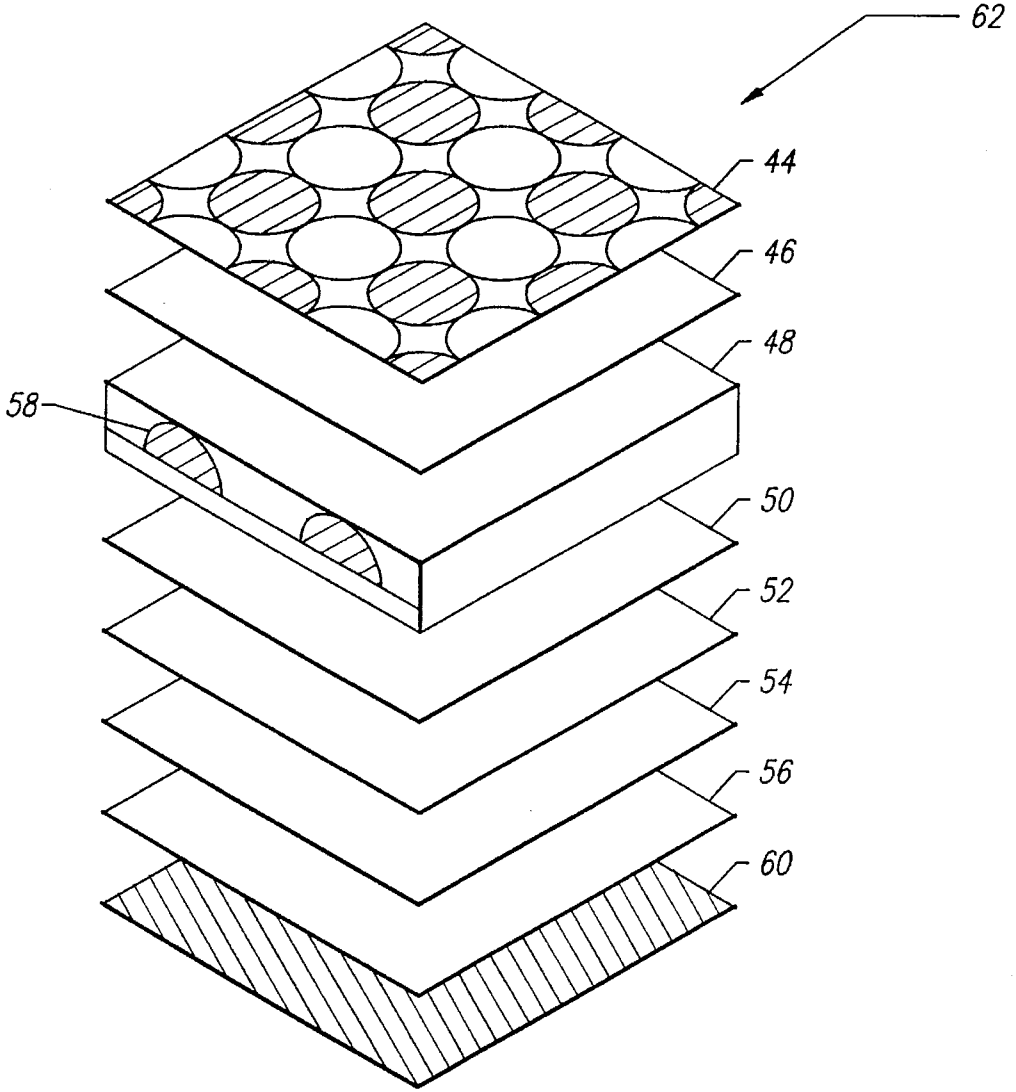
FIG. 2 is a perspective view of a preferred embodiment stacked subarray.

FIG. 2 provides a perspective view of a single subarray element 62 constructed in accordance with a preferred embodiment of the present invention, parts of which are shown schematically in FIG. 1. The subarray element 62 is preferably disposed on substrates made from aluminum nitride wafers. Of course, generic silicon wafers are also acceptable. The total subarray assembly of wafers, by virtue of their appearance, is often called a tile.

Importantly, these tiles can be assembled side-by-side into any size, two-dimensional array. FIG. 2 shows only a single tile, for the sake of clarity. The number of tiles that are assembled together can be adjusted to fit an antenna array for a missile, tactical aircraft, spacecraft or ground- and ship-based radar. Because the tiles are lightweight and have a low profile, they can easily be integrated into the skins of an aircraft or missile.

Therefore, FIG. 2 is the structural embodiment of parts of the electronics shown in the block diagram of FIG. 1, wherein the devices are disposed in a plurality of stacked planes or wafers. In the preferred embodiment, the laser transmitter 12 and the photodiode detector receiver flip chips 32 are disposed on plane 60. The signal is fed vertically to plane 56 containing the logic circuits or means for controlling 40. Plane 56 is immediately above plane 60 and contains active RF components such as true time delay circuits, variable attenuators, summers, and like circuitry. Each of these components is known in the radar electronics art and is not described in detail here. Suffice it to say that the true time delay circuits are used to electronically steer the radar beam emitted from the radiator 44. The variable attenuators make up part of the receive amp 24 and the transmit amp 22 shown in FIG. 1. The variable attenuator functions to attenuate the incoming signal from the receive amp in order to prevent saturation of the receiving means electronics, while the attenuator at the transmit amp 22 functions to shape the waveform of the beam by modulating the magnitude of the propagating waveform from each subarray. In other words, the attenuator operates as gain control to prevent saturation of the circuitry from the output of the receive amp 24, and the attenuator during the transmit mode adjusts the beam weighting to obtain a desired waveform.

The summer can be positioned at the RF distribution manifold 14 as shown in FIG. 1 and functions as a summing device or splitting device so that the signal from the RF distribution manifold 14 can be split among the subarrays 42 during transmission and can be summed as the reflected microwaves are received from the subarrays 42 to produce a corporate feed to the receiver 32. The technology of using a summer in phased array radar is known in the art. The next layer up on plane 52 contains the RF distribution manifold 14. Directly above plane 52 is plane 50 comprising the high power transmit amplifier 22 and the low noise receive amplifier 24. Immediately adjacent to plane 50 is plane 48 comprising a cold plate. A cold plate is needed to dissipate the heat build up generated from microwave transmission. To further conduct away heat, the cold plate includes cooling channels, whose manifolds 58 are shown in the drawing. Coolant is cycled through the manifolds to cool the subarray 62 through any process known in the art. Above the cold plate 48 is the ground plane 46, which forms a part of the radiator. Finally, above the ground plane is the radiator or antenna 44.

Of course, the devices described above can be rearranged and located on other planes aside from that shown. Also, the devices employed in the present invention including, for example, the receiver, transmitter, etc. are all known in the art and need not be specially modified or adapted for use in the present invention. In sum, the same technology used in manufacturing large batches of electrical substrates can be likewise used to fabricate the radiators, the distribution manifolds for the RF, DC and logic signals, and even the cooling manifold. Vertically disposed electrical interconnects between tiles of different planes can be achieved using conventional vias or coplanar microwave microbridges, or like technology known in the art. In fact, photodiodes and fiber optic cables can be incorporated into the tile stack to provide optical communication between planes and can provide inputs and outputs to the subarray tiles.

Furthermore, the devices such as the low noise amplifiers can be embodied in galium arsenic circuits that also incorporate flip chip designs. That is, the chip is flipped when mounted to the interconnects. The chips are simultaneously electrically connected to the substrate by reflowing the sodder bumps that are disposed on top of the flip chip, and that are next to the wafer after the chip is flipped.

The aluminum nitride wafer was selected because of its superior heat conduction capabilities due to the presence of the aluminum, but it is also a good insulator because of its other characteristics that make up its ceramic material structure. Further, the chip is preferably an MMIC Chip, known in the art.

Because the device chips are exposed on each wafer, the present invention employs hermetic sealing by use of a conformal coating process. Because the conventional box or packaging containing the electronics has been eliminated in the present invention, the MMIC Chips are embedded in holes or depressions provided in the substrate. A coating of polymer is then spread over the MMIC Chip to protect it from the environment, thus replacing the box.

As mentioned above, the present invention may use lasers and vertical RF interconnectors or, optionally, use photonic interconnects. For photonic interconnects, accordingly, photodiodes (fiber optic links) convey optical signals through fiber optic cables to transmit data from one plane to another and/or to and from the entire tile or subarray. Hence, the fiber optic cables run vertically between planes or into and out of a plane to the outside. The RF modulated light beam when received by another photodiode in another plane is demodulated back to an electrical signal. This process is known in the art and is easily adaptable to the present invention's stacked tiles.

What is claimed is:

1. A subarray in an active array used for transmission and reception of a microwave RF signal, said microwave signal being generated in an exciter, said subarray comprising:

a manifold to convey the microwave signal from the exciter;

beam steering means, for steering the microwave signal received from the manifold;

a transmit amplifier connected to the beam steering means, for amplifying the microwave signal prior to transmission;

an antenna connected to the transmit amplifier, for propagating the microwave signal toward a target and for receiving a reflected microwave signal reflected from the target; and a receive amplifier, for amplifying the reflected microwave signal from the antenna;

wherein the receive amplifier directs the reflected microwave signal to the beam steering means, which then transmits the reflected microwave signal to the manifold, which then transmits the reflected microwave signal to a receiving means, for interpreting and outputting the reflected microwave signal; and wherein discrete, active high-frequency RF components including the transmit amplifier, the receive amplifier, and the beam steering means are disposed on a plurality of planes aligned in a column so that the reflected microwave signal is transmitted vertically among the discrete, active high-frequency RF components disposed on the plurality of planes.

2. The subarray, according to claim 1, wherein the subarray further comprises a switch for alternately activating the transmit amplifier and the receive amplifier.

3. The subarray, according to claim 2, wherein the steering means further comprises a phase shifter.

4. The subarray, according to claim 3, wherein the subarray further comprises a controller, disposed on one of the plurality of planes, for controlling the subarray.

5. The subarray, according to claim 4, wherein the receiving means further comprises a summer for summing the reflected microwave signal, a receiver, and a signal processor to interpret the reflected microwave signals, wherein the summer, the receiver, and the signal processor are disposed on the plurality of planes.

6. The subarray, according to claim 5, wherein the transmit amplifier comprises a high power transmit amplifier.

7. The subarray, according to claim 6, wherein the receive amplifier comprises a low noise amplifier.

8. The subarray of claim 7, wherein the subarray further comprises photonic interconnects, interconnecting at least two of the plurality of planes.

9. The subarray of claim 8, wherein at least one of the plurality of planes comprises an aluminum nitride ceramic wafer.

10. A subarray in an active array used for transmission and reception of a microwave signal, said subarray comprising:

antenna means for transmitting and receiving said microwave signal;

means for amplifying said microwave signal from said antenna means;

means for phase shifting said microwave signal from said means for amplifying;

means for attenuating said microwave signal from said means for shifting;

means for switching said antenna means and means for amplifying, phase shifting, and attenuating;

means for controlling said antenna means and means for amplifying, phase shifting, attenuating and switching; and wherein discrete, active high-frequency RF components including said means for amplifying, phase shifting, attenuating, and switching are disposed on a plurality of planes stacked vertically and said microwave signal is transmitted vertically between said discrete, active high-frequency RF components disposed on said stacked planes.

11. A subarray, according to claim 10, wherein at least one interconnection among the antenna means, means for amplifying, means phase shifting means for attenuating, means for switching, and means for controlling is a photonic interconnection.

12. A subarray, according to claim 11, wherein at least one of said antenna means and means for amplifying, phase shifting, attenuating, switching and controlling includes a monolithic microwave integrated circuit flip chip.

13. A subarray, according to claim 12, wherein at least one of said planes is an aluminum nitride wafer.

14. A subarray, according to claim 13, wherein said monolithic microwave integrated circuit flip chip is coated with a conformal hermetic coating.

15. A subarray, according to claim 14, wherein said planes further include microchannels for cooling.

16. A method for building a subarray in an active array used for transmission and reception of a microwave signal, said method comprising the steps of:

providing an antenna for interfacing said microwave signal;

providing a means for amplifying said microwave signal from said antenna;

providing a means for phase shifting said microwave signal from said means for amplifying;

providing a means for controlling said means for amplifying and phase shifting;

disposing discrete, active high-frequency RF components including said antenna and said means for amplifying, phase shifting and controlling on a plurality of planes; and stacking said plurality of planes in an overlying relationship such that said microwave signal is transmitted vertically among said discrete, active high-frequency RF components disposed on said planes.

17. An electronic component for processing a microwave signal, comprising:

an antenna for interfacing said microwave signal;

means for amplifying said microwave signal from said antenna;

means for phase shifting said microwave signal from said means for amplifying; and means for controlling said microwave signal from said means for phase shifting;

wherein discrete, active high-frequency RF components including said means for amplifying, and phase shifting are disposed on a plurality of planes stacked in an overlying relationship and said microwave signal is transmitted vertically between said discrete, active high-frequency RF components disposed on said planes.

* * * * *